US005271435A

United States Patent [19]

Maina

[11] Patent Number: 5,271,435

[45] Date of Patent: Dec. 21, 1993

[54] WEFT FEEDER WITH BRISTLE CONTAINING STOPPING PIN CAVITY

[75] Inventor: Bruno Maina, Valdengo, Italy

[73] Assignee: ROJ Electrotex S.p.a., Biella, Italy

[21] Appl. No.: 652,593

[22] Filed: Feb. 1, 1991

[30] Foreign Application Priority Data

Feb. 5, 1990 [IT] Italy ..... 19259 A/90

[51] Int. Cl.[5] ..... D03D 47/36

[52] U.S. Cl. ..... 139/452

[58] Field of Search ..... 139/452; 242/47.01; 66/132 R, 132 T

[56] References Cited

U.S. PATENT DOCUMENTS

| | | | |
|---|---|---|---|
| 4,226,379 | 10/1980 | Brouwer et al. | 139/452 |
| 4,530,381 | 7/1985 | Takegawa | 139/452 |
| 4,744,394 | 5/1988 | Lincke | 139/452 |
| 5,016,681 | 5/1991 | Ghiardo | 139/452 |

FOREIGN PATENT DOCUMENTS

| | | | |
|---|---|---|---|
| 0247967 | 12/1987 | European Pat. Off. . | |
| 1516535 | 10/1989 | U.S.S.R. | 139/452 |

*Primary Examiner*—Andrew M. Falik

*Attorney, Agent, or Firm*—Young & Thompson

[57] ABSTRACT

A measuring weft feeder for fluid jet looms which measures the weft yarn lengths being inserted into the loom shed is disclosed. The weft feeder comprises an electric motor for rotating a winding arm, a drum held stationary around which the arm winds up the yarn into even turns, forming a weft yarn reserve whose length is controlled by means of suitable sensors, and a yarn stopping device. The yarn stopping device includes a rod for engaging and stopping the yarn at the outlet of the feeder. The rod is movable between a withdrawn rest position and a projecting yarn stopping position in which its end moves into a cavity formed for such purpose on the drum periphery, close to the free end thereof. The drum cavity has mounted therein a plurality of bristles positioned transversely to the rod of the yarn stopping device, so that the rod may engage the bristles, crossing them at least partially, when assuming its projected position to stop the weft yarn.

5 Claims, 2 Drawing Sheets

WEFT FEEDER WITH BRISTLE CONTAINING STOPPING PIN CAVITY

BACKGROUND OF THE INVENTION

The present invention concerns improvements in weft feeders for fluid jet looms, of the type capable of measuring the weft yarn lengths being inserted into the loom shed, known as "measuring weft feeders".

A known weft feeder of this type comprises an electric motor which causes the rotation of a yarn winding arm, and a drum held stationary around which said arm, winds up the yarn into even turns, forming a weft yarn reserve, the length of which is controlled by means of suitable sensors. The loom nozzle, provided to launch the weft yarn into the loom shed, draws from the weft feeder drum the weft yarn length required for each weft insertion. This length is measured and controlled by the weft feeder counting the number of unwound turns by suitable means. As soon as the yarn at the outlet of the weft feeder, to be launched into the loom shed, has reached the predetermined length, it is stopped on the drum by means of a device comprising a rod adapted to engage the yarn at the outlet of the feeder. The rod is movable between a withdrawn rest position and a projecting working position in which the end of the rod moves into a cavity formed on the drum periphery for this purpose close to its free end, so as to stop the weft yarn by engaging the same as it unwinds from the drum. Preferably, the weft yarn stopping device is an electromagnetic device, wherein said rod projects from a movable core, which comprises a head of ferromagnetic material subject to the contrasting actions of at least an electromagnetic coil and of a return spring, allowing the rod to move alternatively into the projecting yarn stopping position and into the withdrawn rest position.

The rod stopping device of measuring weft feeders is, in most cases, quite valid and reliable. However, it sometimes happens that the weft yarn may slip away under the rod of the stopping device and move beyond the same, by wedging into the drum cavity housing the end of said rod and passing between the rod and the bottom of said cavity without stopping, or stopping with some delay, which irreparably alters the exactness of the measurement and even causes serious inconveniences to the working of the weft feeder and of the loom.

This phenomenon mostly occurs with yarns having a strong twist or a high rigidity, as they are being cut by the loom shears after weft insertion. It is mainly determined by the sudden change in weft yarn tension when cutting takes place, which causes longitudinal and transversal oscillations between the yarn stopping point on the measuring weft feeder and its cutting point on the loom. These oscillations cause jumping of the yarn, which thus wedges in between the end part of the stop rod and the bottom of the drum cavity, without stopping.

For this purpose, a small space is usually provided between the end of the stop rod and the bottom of the drum cavity, by forming the rod limit stop means directly inside the structure of the electromagnetic stopping device. This solution is more apt to guarantee the working of said stopping device.

When the weft yarn slips away, passing under the stop rod, there is of course a measuring error which generally produces a weft insertion longer than required or, in the case of a loom working with several colors the insertion of a weft length in the successive beating up together with the correct insertion of a different color.

Attempts have been made in the past to overcome this drawback, by providing for the free end of the stop rod to come in contact with an element positioned at the bottom of the drum cavity. This element has to be sufficiently elastic, so as not to form a limit stop, and sufficiently resistant to rubbing wear, caused both by the yarn trying to slip away and by the rod hitting against the yarn.

Nevertheless, by adopting this system, it is the one hand difficult to positively prevent any rebounds of the stop rod; which are obviously harmful from many points of view, and, on the other hand, it has turned out impossible to realize an element against which the rod should stop, being so strong as not to require replacement after short periods of use of the weft feeder.

SUMMARY OF THE INVENTION

The present invention now proposes a fully original solution to this problem, which is besides highly satisfactory as seen hereinafter.

The solution, applied to a measuring weft feeder of the aforementioned type, consists in mounting, into the drum cavity designed to house the end of the rod of the weft yarn stopping device, a plurality of bristles which are positioned therein transversally to said rod, so that this latter may engage the plurality of bristles, crossing it at least partially, when taking up its projecting position to stop the weft yarn.

Preferably, the plurality of bristles is formed as a brush, with the bristles mounted projecting, substantially parallel to the drum axis.

BRIEF DESCRIPTION OF THE DRAWINGS

The invention is now described in further detail, with reference to the accompanying drawings, which illustrate a preferred embodiment thereof, and in which:

FIGS. 3 to 5 showing in further detail the arrangement according to the invention.

DESCRIPTION OF THE PREFERRED EMBODIMENT

Figure 1:
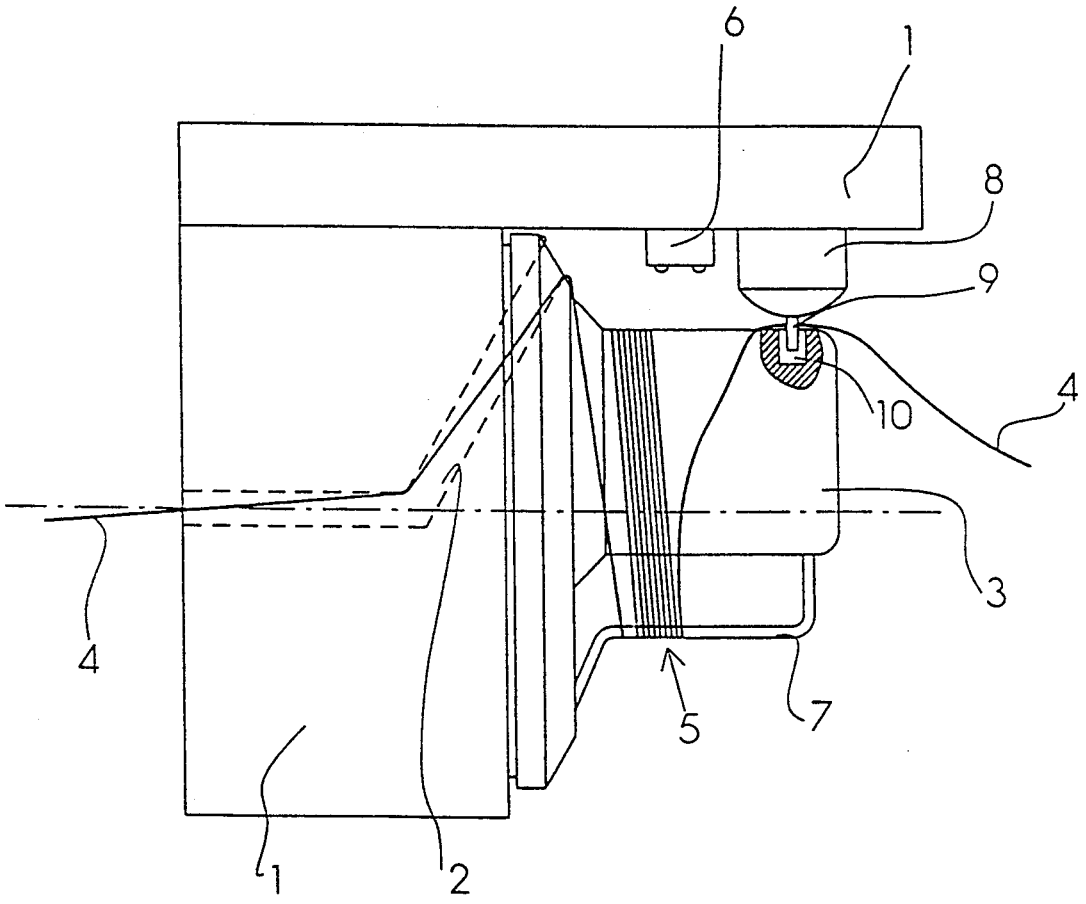
FIG. 1 is a lateral view of a measuring weft feeder, onto which the invention has been applied.
Figure 5:
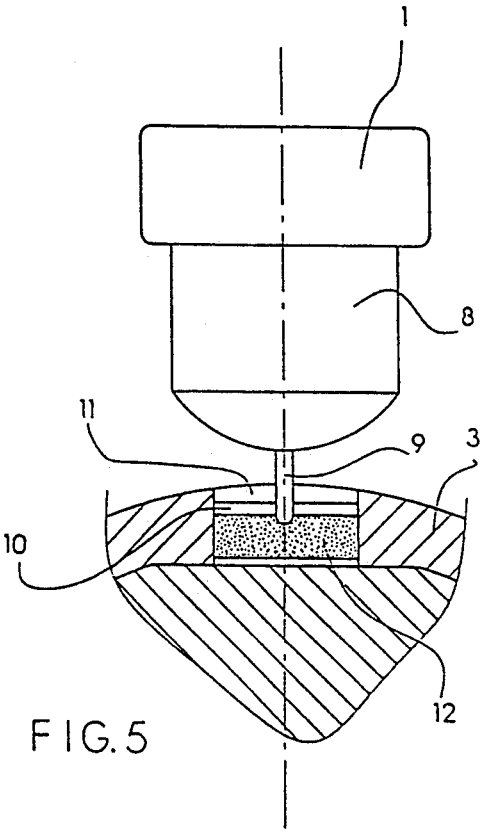
FIG. 5 is a section view along line V—V of FIG. 3.
Figure 2:
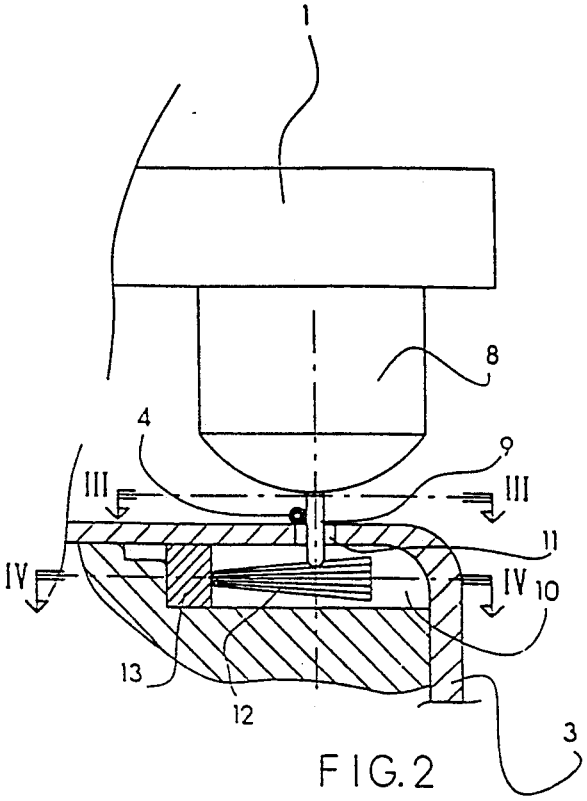
FIG. 2 is a lateral view, on an enlarged scale, of the yarn stopping device of said weft feeder and of the drum cavity housing the end of the yarn stop rod, said cavity comprising the arrangement according to the invention.
Figure 3:
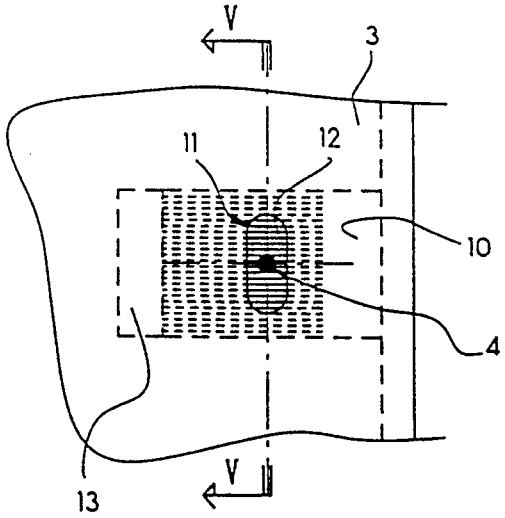
FIGS. 3 and 4 are section views, respectively along lines III—III and IV—IV of FIG. 2.
Figure 4:
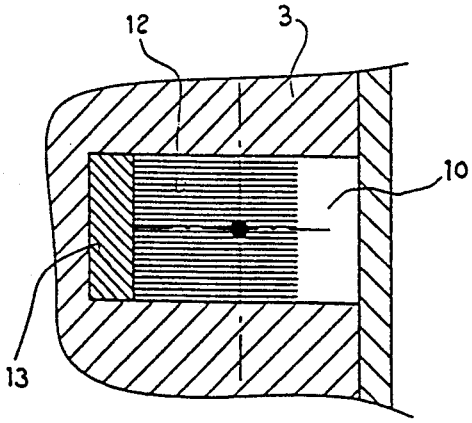

FIG. 1 shows diagrammatically a measuring weft feeder to feed the weft yarn to fluid jet looms. In known manner, the weft feeder houses into its body 1 an electric motor causing the rotation of a winding arm 2, and comprises a drum 3 held stationary around which said arm 2 winds up the weft yarn 4 into even turns, forming a reserve 5 controlled by sensors 6, the length of said yarn turns being adjustable by changing the radial position of columns 7 which allow to vary the diameter of the drum 3. In this measuring weft feeder the weft yarn 4 being fed to the loom is stopped after a predetermined length thereof has been withdrawn. This operation is accomplished by the yarn stopping device 8, when its rod 9 is moved into the projecting position and introduced into the cavity 10 provided therefor on the periphery of the drum 3, close to its free end, to thereby engage and stop the yarn 4.

The yarn stopping device is preferably an electromagnetic device comprising a body fixed to the measuring weft feeder, which houses at least one electromagnetic coil, a spring and a movable core provided with a ferromagnetic head able to respond to the contrasting actions of the coil and of the spring. The yarn stop rod or pin 9 projects from the movable core. The yarn stopping device could also have different characteristics (nor does it necessarily have to be an electromagnetic device).

In the drawings, the yarn stopping device 8 is shown in a working position, with the rod 9 penetrating through a slit 11 into the cavity 10 provided therefor on the drum 3. From FIGS. 2–5 of the drawings, it will be seen that the cavity 10 has a greater axial extent than the slit 11, and that slit 11 extends over only a portion of the periphery of the drum 3.

According to the invention, into the cavity 10 there is mounted a plurality of natural or artificial bristles 12, positioned in the form of a brush transversally to the rod 9 which, when moving into a projecting yarn stopping position, engages the bristles 12 and crosses them at least partly.

The plurality of bristles 12 are preferably mounted, as shown, with the bristles projecting from a support body 13 and extending parallel to the axis of the drum 3 (and thus substantially perpendicular to the stop rod 9).

This simple arrangement positively prevents the forming of a space to allow yarn passage, even when the yarn undergoes irregular movements or sudden tension changes, while housing the end of the yarn stop rod without opposing any resistance (and thus without wearing, or causing even slight undesirable rebounds of the stop rod).

The material forming the bristles is preferably artificial or obtained from an animal source, but it could also be of mineral or vegetal origin.

Even if the arrangement preferred at present is that shown in the drawings, with the bristles positioned parallel to the weft feeder axis, it is also possible to mount said bristles in a dirrerent position, for instance transversal to or inclined in respect of said axis.

It is deemed that the proposed solution is able to solve most satisfactorily the problem at hand. In fact, the following advantages are obtained.

1) The actual nature of the bristles, which have long been used in the construction of weft feeders, as brake elements for adjusting weft yarn tension, provides a high resistance to wear caused by contact with the yarn and with the stop rod;

2) The brush arrangement of the bristles allows a soft and efficient penetration of the yarn stop rod, thereby preventing the forming of spaces for the passage of yarn therebeneath.

3) The bristles, besides causing no rebounds of the stop rod, prevent its end from getting damaged through impact;

4) The high elasticity of the bristles allows slight oscillations of the drum about its axis, without causing any damage either to the stop rod or to the bristles.

It is understood that there may be other practical embodiments of the invention, differing from that heretofore described and illustrated, without thereby departing from the protection scope thereof.

I claim:

1. Weft feeder for fluid jet looms adapted to measure the length of weft yarn being inserted into a loom shed comprising: an electric motor causing the rotation of a winding arm, a drum held stationary around which said arm winds up the yarn into even turns, forming a weft yarn reserve whose length is controlled by means of sensors, and a yarn stopping device comprising a rod adapted to engage and stop the yarn from feeding; said rod being movable between a withdrawn rest position and a projecting yarn stopping position in which its end passes through a slit into a cavity formed on the drum periphery, said drum cavity having mounted therein a plurality of bristles positioned transversally to the rod of the yarn stopping device, so that said rod may engage said bristles, crossing them at least partially, when the rod assumes its projecting position to stop the weft yarn, said drum cavity having a greater axial extent than said slit through which said rod passes, and said slit and drum cavity extending over only a portion of said drum periphery.

2. Weft feeder as in claim 1, wherein said plurality of bristles is a brush in which the bristles extend parallel to one another.

3. Weft feeder as in claim 1, wherein the bristles of said plurality of bristles are mounted projecting from a support body.

4. Weft feeder as in claim 1, wherein the bristles of said plurality of bristles are positioned substantially parallel to the drum axis.

5. Weft feeder as in claim 1, wherein said yarn stopping device is an electromagnetic device.

* * * * *